US005307856A

United States Patent [19]

Murray

[11] Patent Number: 5,307,856

[45] Date of Patent: May 3, 1994

[54] AUTOMATICALLY RETRACTABLE AWNING

[75] Inventor: Brent W. Murray, Longmont, Colo.

[73] Assignee: Carefree/Scott Fetzer Company, Broomfield, Colo.

[21] Appl. No.: 982,512

[22] Filed: Nov. 27, 1992

[51] Int. Cl.[5] ..... E04F 10/06

[52] U.S. Cl. ..... 160/70; 160/22; 160/310

[58] Field of Search ..... 160/22, 66, 69, 70, 160/78, 79, 120, 121.1, 310, 311, 312, 1, 7; 135/89

[56] References Cited

U.S. PATENT DOCUMENTS 2,083,726 6/1937 Mason .
3,779,302 12/1973 Akers et al. .
3,847,171 11/1974 Akers et al. .
3,964,038 6/1976 Rutherford .
4,034,174 7/1977 McCord .
4,160,458 7/1979 Marcellus .
4,615,371 10/1986 Clauss .
4,788,534 11/1988 Englehardt .

OTHER PUBLICATIONS

Halen Co. brochure for the Halcomaster® WZA-1900.

*Primary Examiner*—David M. Purol
*Attorney, Agent, or Firm*—Gary M. Polumbus

[57] ABSTRACT

An automatically retractable awning includes a plurality of extendable rafter arms operatively connected at their upper ends to a vertical support surface, a lead bar connected to the lower ends of the rafter arms, a roll bar located adjacent to and operatively connected to the support surface, and an awning sheet or canopy connected at a first end to the roll bar and at a second end to the lead bar. A sensor operatively connected to at least one of the rafter arms detects pivotal movement of the rafter arm relative to the support surface and automatically commands a roll drive motor to roll the canopy about the roll bar and thus retract the awning.

17 Claims, 7 Drawing Sheets

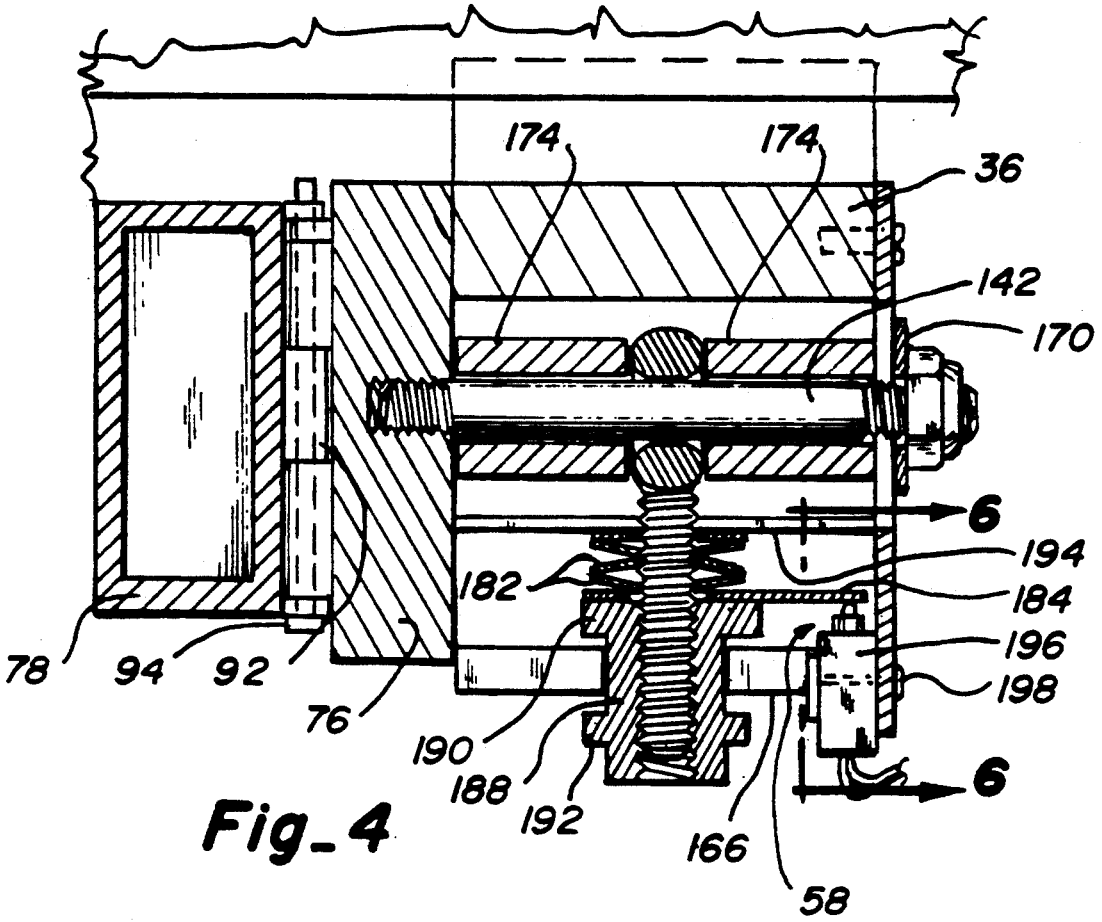
Fig_4
Fig_5
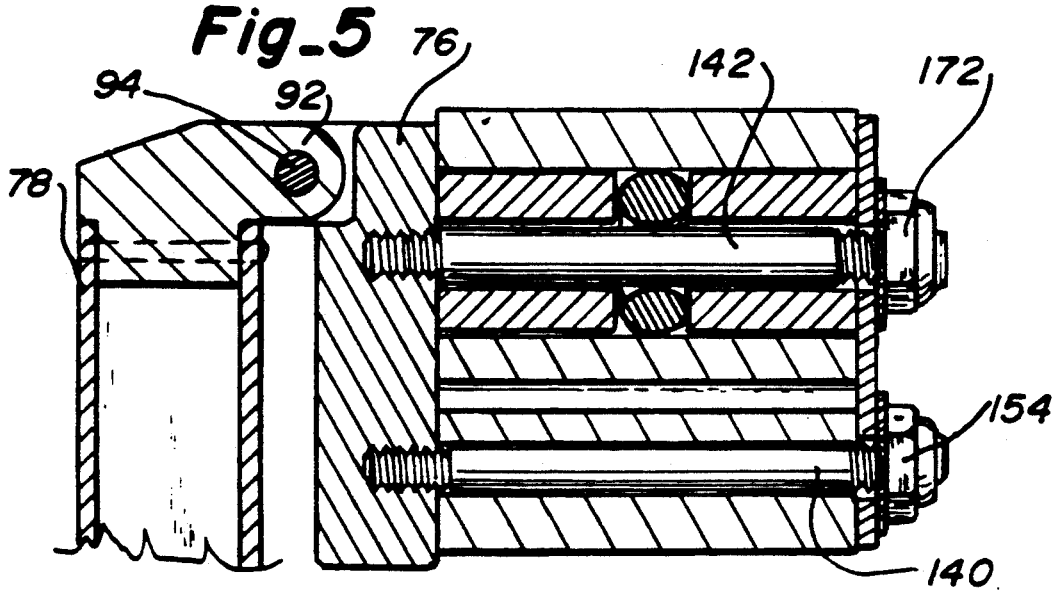

AUTOMATICALLY RETRACTABLE AWNING

BACKGROUND OF THE INVENTION

1. Field of the Invention

The present invention relates generally to retractable awnings of the type adapted to be mounted on a substantially vertical surface and including a roll bar about which a canopy can be rolled. More specifically, the invention relates to a retractable awning including a sensor adapted to sense movement of the awning as might occur in inclement weather with the sensor operably connected to a motor to automatically retract the awning under predetermined conditions.

2. Discussion of the Prior Art

Retractable awnings have been in use for many years with early uses being primarily as covers for windows, doors and the like. More recently, retractable awnings have been designed for use on mobile structures such as recreational vehicles and mobile homes. As will be appreciated, when such an awning is in use, wind currents and the like tend to move the awning and sometimes the awning is moved so far as to damage the structural members of the awning. Further, the awning sheet or canopy attached to the structural members of the awning may be torn or otherwise damaged by the wind. In addition, precipitation can accumulate on top of the canopy possibly causing damage to the canopy and other structural members of the awning.

Most modern retractable awnings include a roll bar about which the canopy is rolled and unrolled and at least a pair of support arms to support the extended canopy. As will be appreciated, the strength and mounting of the support arms is designed so as to be sufficient to support the canopy and to withstand certain additional forces. However, it is desirable to protect the awning and support arms from more severe forces such as those created by wind and rain storms. In addition, retractable awnings may be subjected to such storms at times when the owners or occupants of the structure on which the awning is mounted are away or asleep. Accordingly, it is desirable to provide an awning which automatically retracts when subjected to severe forces.

It is known in the art to provide a retractable awning with an electric motor to roll and unroll the awning and limit switches to prevent unwanted rolling after the awning is fully extended or retracted, as demonstrated by U.S. Pat. No. 4,615,371 issued to Clauss. Further, it has been suggested that a photoelectric sensor may be used to detect ambient light conditions and control a motorized awning in response thereto as described in U.S. Pat. No. 2,083,726 issued to Mason. In addition, there exist control systems for retractable awnings which include a windmill mounted on top of the structure or vehicle which is operatively connected to a motor to retract the awning when the wind speed exceeds a predetermined threshold. Unfortunately, these sensors are unsightly. With the exception of windmill type sensors, these and other systems do not suggest the use of such a sensor to detect movement of an awning due to wind or precipitation and, in response thereto, to automatically retract the awning to prevent damage from the wind or precipitation. It is to overcome such shortcomings in the prior art that the present invention has been developed.

SUMMARY OF THE INVENTION

The automatically retractable awning of the present invention is adapted for mounting on a support surface so as to be moveable between an extended and retracted position. The awning includes an awning sheet connected along one edge to a roll bar. The roll bar is selectively rotatably driven in opposite directions by a motor to extend and retract the awning. The awning is supported by at least two extendable rafter arms operably connected to the support surface.

The awning includes a sensor adapted to sense a predetermined amount of movement of at least one of the rafter arms and, in response thereto, energize the motor to retract the awning by rolling the awning sheet about the roll bar.

In the preferred embodiment of the invention, the sensor includes a concealed contact switch positioned adjacent to one of the rafter arms. The rafter arm is mounted for minimal pivotal movement which can be sensed by the contact switch to energize the motor to retract the awning.

Other aspects, features and details of the present invention can be more completely understood by reference to the following detailed description of the preferred embodiment, taken in conjunction with the drawings, and from the appended claims.

DETAILED DESCRIPTION OF THE DRAWINGS

FIG. 4 is a fragmentary section taken along line 4—4 of FIG. 3.

FIG. 5 is a fragmentary section taken along line 5—5 of FIG. 3.

DESCRIPTION OF THE PREFERRED EMBODIMENT

Figure 2:
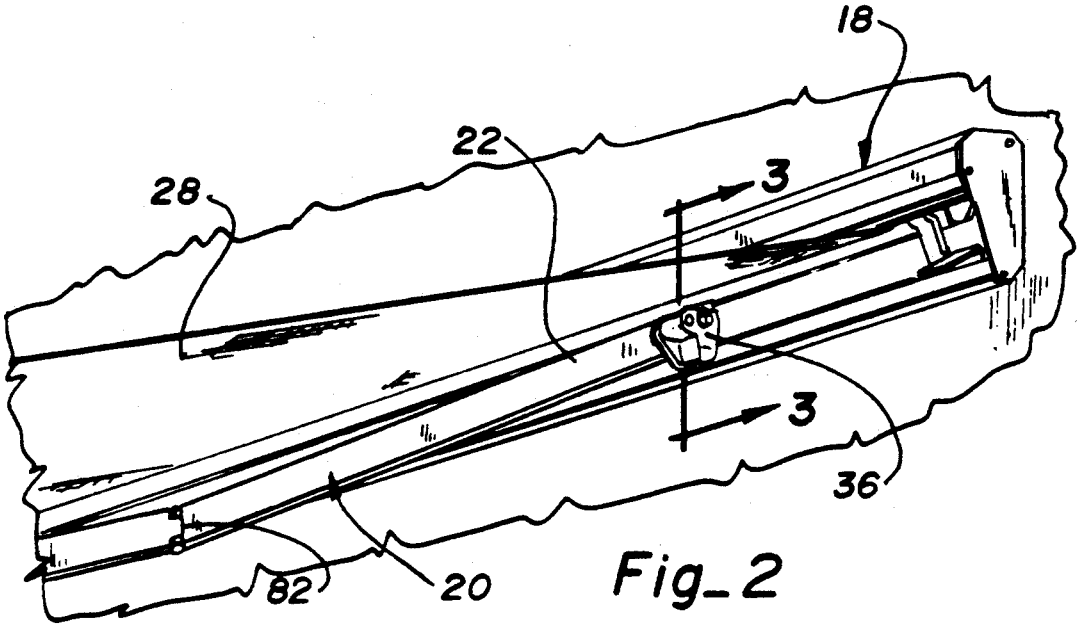
FIG. 2 is another fragmentary isometric view of the awning of the present invention looking upwardly from beneath the awning sheet.
Figure 1:
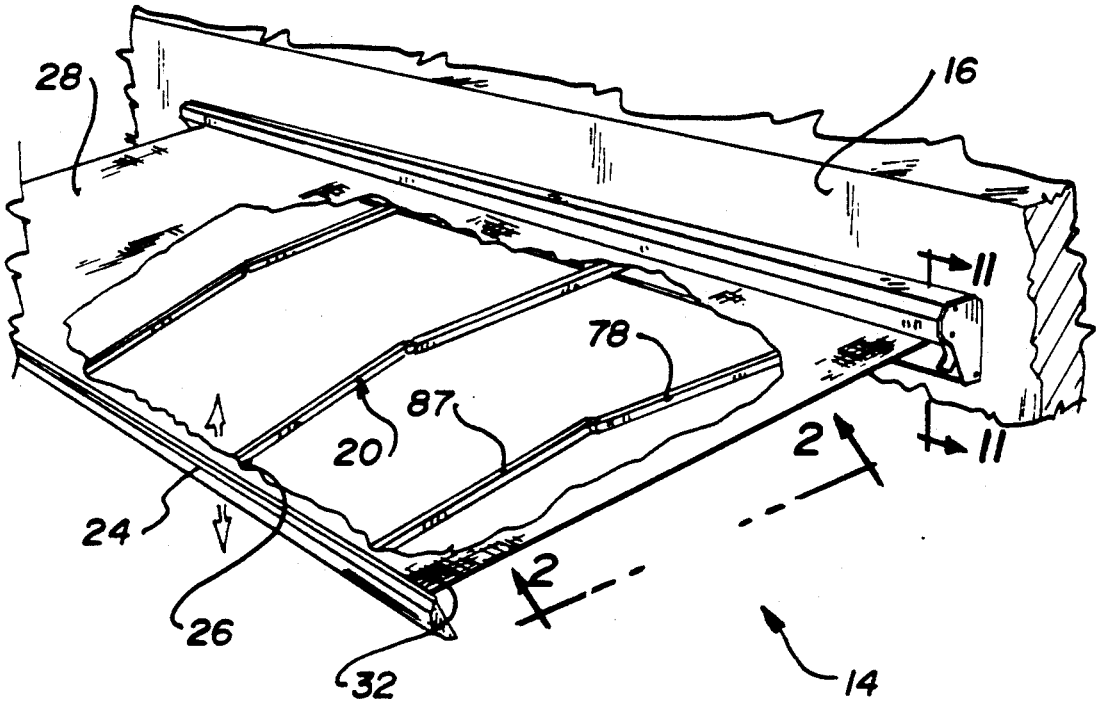
FIG. 1 is a fragmentary isometric view of the automatically retractable awning of the present invention in an extended condition and with a portion of the awning sheet cut away to reveal three of the rafter arms.
Figure 11:
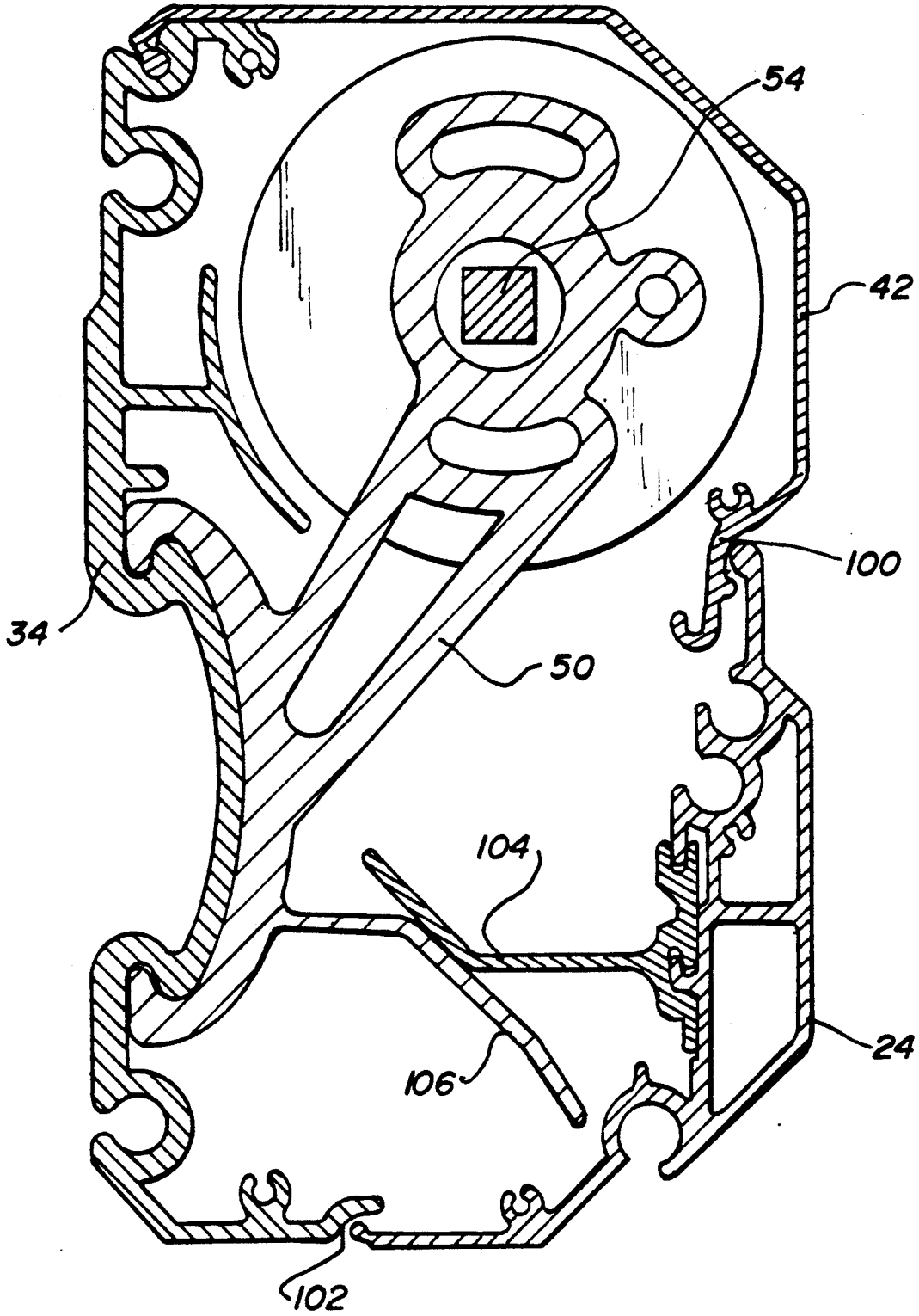
FIG. 11 is a enlarged section taken along line 11—11 of FIG. 1.

The automatically retractable awning 14 of the present invention is of the type that is adapted to be mounted on a substantially vertical support surface 16 so as to be moveable between extended and retracted positions adjacent to that surface. As shown in FIGS. 1, 2 and 11, the awning 14 includes a support assembly 18 mounted to the vertical support surface 16, a plurality of extendable rafter arms 20 connected at an upper end 22 to the support assembly, a lead bar 24 parallel to the support assembly and connected to a lower end 26 of the extendable rafter arms and an awning sheet or canopy 28 connected along one edge 30 to the support assembly and along an opposite edge 32 to the lead bar.

Figure 3:
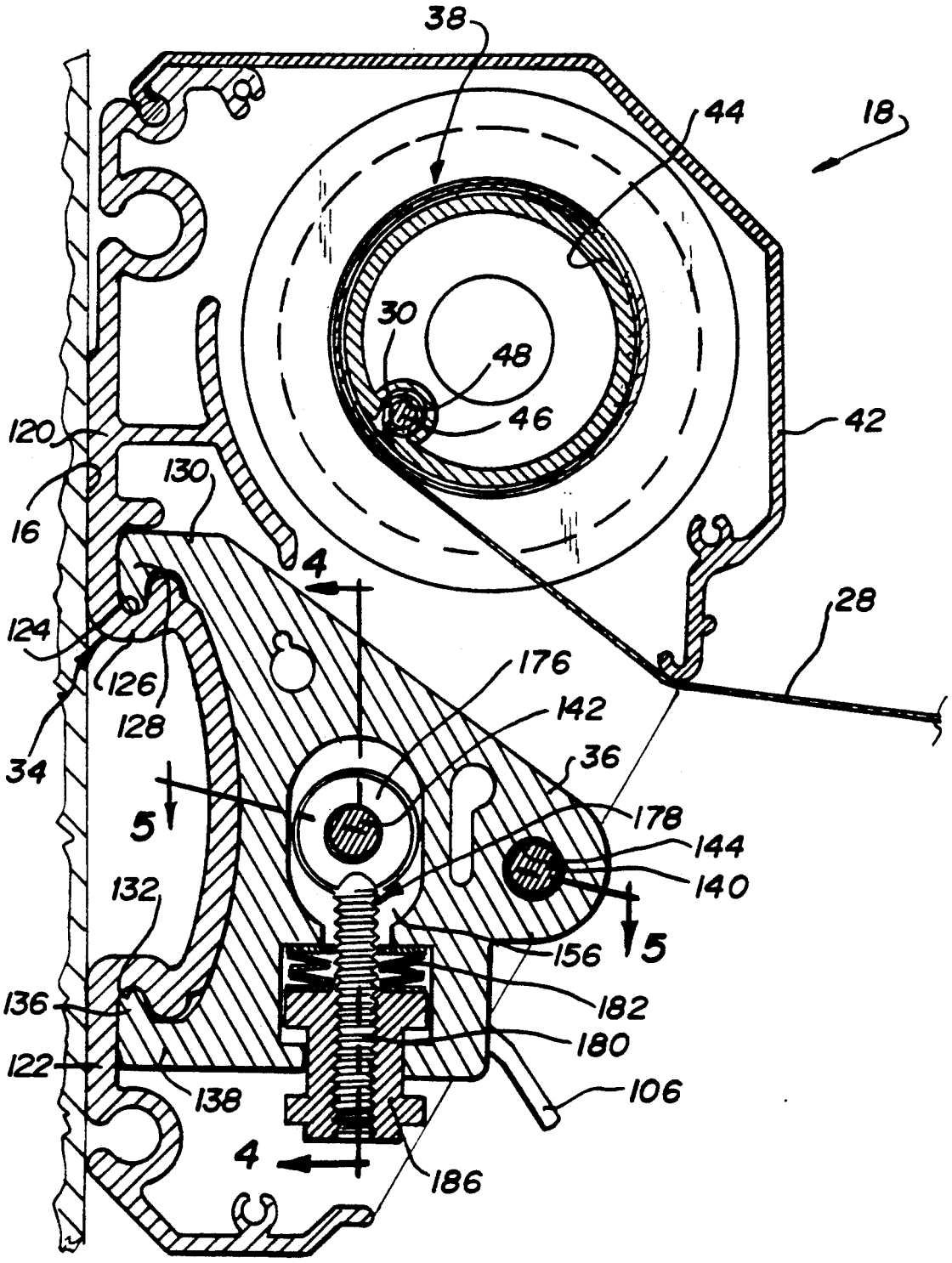
FIG. 3 is an enlarged fragmentary section taken along line 3—3 of FIG. 2.

As can best be seen in FIG. 3, the support assembly 18 includes a mounting bracket 34 attached to the support surface 16, a plurality of rafter arm support brackets 36 for individually supporting each of the extendable rafter arms 20, a roll bar assembly 38 for rolling and unrolling the canopy 28 as the awning 14 is retracted and extended, respectively, a reversible drive motor 40 for rolling and unrolling the roll bar assembly and a roll bar housing 42 connected to the mounting bracket and covering the roll bar assembly.

The roll bar assembly 38 best seen in FIG. 3, includes a long cylindrical roll bar 44 about which the canopy 28 can be rolled. The canopy is secured to the roll bar in any conventional manner such as by a securement rod 46 provided in a longitudinal channel 48 formed in the outer surface of the roll bar as shown in FIG. 3. The canopy 28 is secured at its opposite edge 32 to the lead bar 24 in an identical manner.

Figure 7:
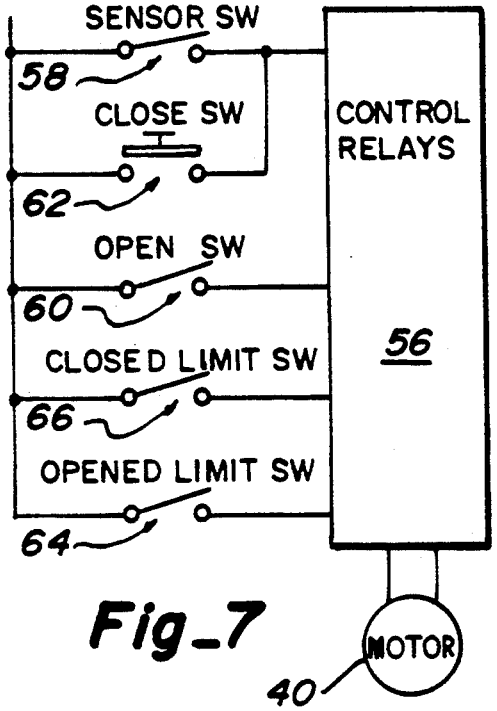
FIG. 7 is a schematic of the electrical components of the present invention.
Figures 10, 12:
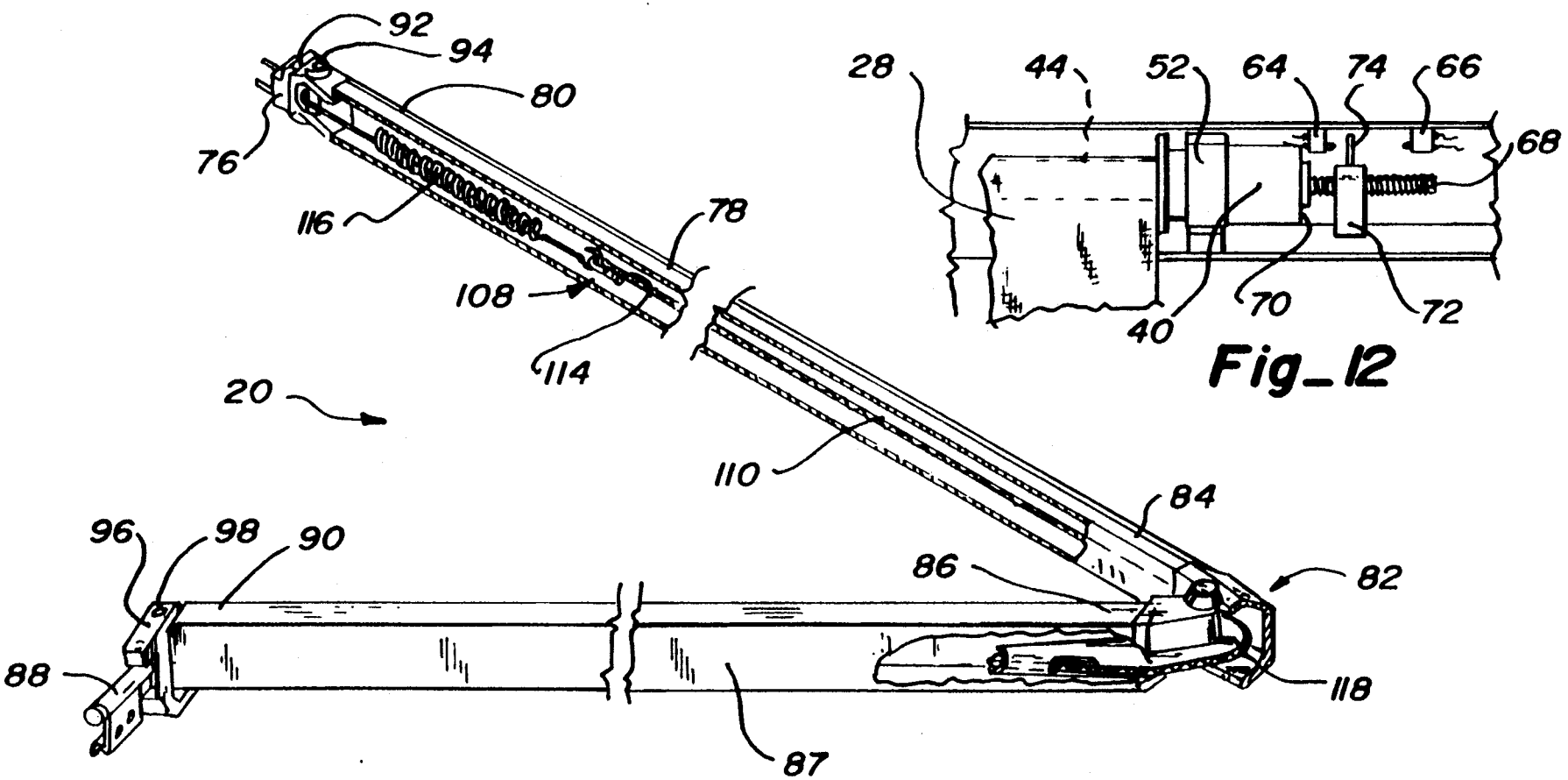
FIG. 10 is a fragmentary isometric view of one of the extendable rafter arms with a portion of the arm cut away to reveal the spring/cable bias system.
FIG. 12 is a schematic of the awning sheet, the roll drive motor and the limit switches associated therewith.

The roll bar 44 is supported by a pair of roll bar support brackets 50 (FIG. 11) mounted to the mounting bracket 34 for supporting the roll bar at either end thus permitting the roll bar to easily rotate in opposite directions. The reversible roll bar drive motor 40 (FIG. 12) is mounted to the support assembly 18 with a motor mounting bracket 52 in a conventional manner (FIG. 12). The drive motor is operatively connected to the roll bar by a first end of a drive shaft 54 having a square cross-section which mates with a similarly shaped opening (not shown) formed in the end of the roll bar. The drive motor is selectively controlled to roll or unroll the canopy about the roll bar by the settings of five switches and the configuration of a set of control relays 56 (FIG. 7). The five switches include a sensor switch 58 which will be discussed in greater detail below, an "open switch" 60 and a "close switch" 62 controlled by an operator to open and close the awning 14, respectively, an "opened limit" switch 64 which indicates that the awning is fully extended and should not be opened further, and a "closed limit" switch 66 which indicates that the awning is fully retracted and should not be retracted further (FIG. 7).

An opposite end 68 of the drive shaft of the drive motor 40 also extends out of an opposite side 70 of the motor from the roll bar 44, as shown in FIG. 12. This end 68 of the shaft is threaded so as to define a worm gear and is provided with a follower 72 thereon which is prevented from rotating so as to be movable along the longitudinal axis of the worm gear upon rotation of the worm gear. The opened limit and closed limit switches 64 and 66 (FIG. 12) are mounted to the roll bar housing 42 in juxtaposed relationship to each other and adjacent to the shaft. The follower 72 is provided with a protruding finger 74 which can contact the contacts of either switch 64 and 66. As the worm gear is turned by the drive motor 40 to roll the roll bar and retract the awning 14, the follower is turned relative to the threaded shaft and thus moved away from the motor and toward the closed limit switch 66. Conversely, as the motor turns the worm gear in the opposite direction to unroll the bar and canopy 28 and allow the awning to extend, the follower is moved toward the motor and toward the opened limit switch 64.

As best seen in FIG. 10, each of the rafter arms 20 includes an upper rafter arm base 76 connected to the rafter arm support bracket 36, an upper rafter arm segment 78 connected at an inner end 80 to the upper rafter arm base, a rafter arm pivot joint or elbow 82 pivotally connecting an outer end 84 of the upper rafter arm segment to an inner end 86 of a lower rafter arm segment 87, and a lower rafter arm base 88 connecting an outer end 90 of the lower rafter arm segment to the lead bar 24. The connection between the upper rafter arm base 76 and the upper rafter arm segment 78 is a pivotal connection provided by a hinge 92 and vertical hinge pin 94. Similarly, the connection between the lower rafter arm base 88 and the lower rafter arm segment 87 is provided by a hinge 96 and vertical hinge pin 98. The hinges and the pivot joint or elbow 82 each allow for pivotal movement of the rafter arm about substantially vertical axes so that the rafter arm pivots in a substantially horizontal plane. Thus, when the rafter arm 20 is completely retracted, it is folded longitudinally and disposed horizontally along the support surface 16 and within the support assembly 18.

As best seen in FIG. 11, the lead bar 24 is formed so that when the awning 14 is fully retracted, the lead bar rests against an outer edge 100 of the roll bar housing 42 and a lower edge 102 of the mounting bracket 34 so as to cover the folded rafter arms 20 and completely enclose the awning. An engagement bracket 104 connected to the lead bar slidingly engages a ramp surface 106 on the roll bar support bracket 50 to guide the lead bar into mating relationship with the roll bar housing and the mounting bracket.

As seen in FIG. 10, the rafter arms 20 are biased into an extended position by a spring/cable bias system 108 comprising a flexible but non-extensible cable 110 anchored at a first end (not seen) to the lead bar 24 and at a second end 114 to a coil spring 116 provided in the interior of the upper rafter arm segment 78 and attached to the inner end 80 of the upper rafter arm segment (FIG. 10). The cable passes through the rafter arm pivot joint or elbow 82 and rests in a groove (not seen) of an arcuate plate 118 located in the pivot joint. The displacement of the groove in the arcuate plate from the pivot pin in the elbow 82 forces the cable, when the joint is pivoted, to stretch the coil spring. In response, the coil spring resiliently biases the cable toward the inner end of the upper rafter arm segment so that the reaction from the support surface 16 urges the rafter arm 20 toward a straightened or extended position.

As mentioned previously, there is a rafter arm support bracket 36 for each of the rafter arms 20. The bracket, shown best in FIGS. 3–6, 8, and 9, is suspended between and attached to an upper section 120 and a lower section 122 of the mounting bracket 34. The upper section has a U-shaped trough 124 running horizontally across a lower edge 126 in which a lip 128 on an upper edge 130 of the rafter arm support bracket is received and retained. Similarly, the lower section of the mounting bracket has an inverted U-shaped trough 132 along an edge 134 in which a lip 136 on a lower edge 138 of the rafter arm support bracket is received and retained.

The support bracket is pivotally attached to the upper rafter arm base 76 by a pivot pin 140 and a anchor pin 142. The pivot pin and the anchor pin are threaded at both ends. The pivot pin and the anchor pin are threadedly attached to the rafter arm base via threaded holes (not seen) provided in the upper rafter arm base. The pivot pin is passed through a cylindrical mating bore 144 in the support bracket. A cover plate 146 covers the opposite side of the support bracket from the upper rafter arm base and is fastened to the support bracket with a fastener 148. A circular opening 150 is provided in the cover plate in alignment with the cylindrical bore in the support bracket so that the exposed threaded end of the pivot pin can extend through the support bracket and the cover plate so as to be secured to the support bracket by a washer 152 and a nut 154. The dimensions of the bore are such that the pivot pin is positively positioned but may freely pivot within the cylindrical bore.

Another opening 156 formed in the support bracket 36 in cross-section has an oval-shaped upper section 158, a rectangularly-shaped intermediate section 160 and a lower section 162 which is also rectangularly-shaped but of smaller dimension than the intermediate section. The intermediate section communicates with the oval-shaped upper section through a neck 164. The lower section of the opening communicates with the exterior of the support bracket through a bottom surface 166 of the support bracket.

The anchor pin 142 is loosely received in the support bracket 36 through the oval-shaped section 158 of the opening 156. An arcuate slot 168 formed in the cover plate 146 is aligned with the oval-shaped section of the opening and receives the threaded second end of the anchor pin. The anchor pin is secured to the support bracket by a washer 170 and nut 172 in a similar fashion to the pivot pin 140 discussed above. Also located within the oval-shaped section of the opening are a pair of centering sleeves 174 which retain an eye 176 of an eyebolt 178 therebetween. The centering sleeves and the eye of the eye bolt are all retained on the anchor pin. A threaded shaft portion 180 of the eyebolt extends vertically downwardly through the opening. The shaft portion thus extends through a portion of the oval-shaped section, the neck 164 and the intermediate and lower rectangularly-shaped sections 160 and 162. Slidably placed onto the shaft of the eyebolt are four spring washers 182 and an extension finger 184 and therebeneath an internally-threaded collar 186 is threaded onto the shaft. The internally-threaded collar acts as a nut on the end of the eyebolt to hold the spring washers and extension finger on the eyebolt. The conventional spring washers are also known as disc springs and can be purchased from the Rolex Company, Hillside, N.J. under Part Number AM231215. The spring washers are compressible so that, at rest, each washer has a height which is significantly greater than its height when the washer is under compression, but they are biased toward the rest condition. The spring washers and extension finger are located on the threaded shaft of the eyebolt within the intermediate rectangularly-shaped section of the opening.

The collar 186 is provided with a main body 188, an upper shoulder 190 and a lower shoulder 192. The upper and lower shoulders each have a width greater than the width of the lower section 162 of the opening 156. Thus, the collar cannot be removed vertically from the lower section of the opening but is vertically slidable therein. The collar is threaded onto the eyebolt 178 such that the upper shoulder is located within the intermediate section 160 of the opening and the lower shoulder is located below the support bracket 36 and thus is on the exterior of the support bracket. The distance between the upper and lower shoulders is greater than the height of the lower section, as best seen in FIGS. 3 and 4, and thus the eyebolt is free to move vertically a predetermined amount within the opening. The position of the eyebolt in the opening relative to the collar is determined by how far the collar is screwed or adjusted onto the eyebolt. As will be appreciated from the previous description of the connection of the rafter arms 20 to their associated support brackets, this adjustment also affects the angle or pitch of the rafter arms relative to the support surface 16. Thus, the pitch of the awning 14 can be adjusted, within limits, by adjustment of the collar.

The eyebolt 178 is held in a relatively fixed position along the length of the shaft of the anchor pin 142 by the pair of centering sleeves 174. The diameters of the sleeves and of the eye 176 of the eyebolt 178 are slightly less than the cross-sectional width of the oval-shaped section 158 of the opening 156 and are significantly less than the cross-sectional height of the oval-shaped section. Therefore, the combination of the anchor pin, eyebolt and sleeves are free to move vertically a predetermined amount within the oval upper section of the opening.

The combined load or weight of the rafter arms 20, canopy 28 and lead bar 24 cause a pivotal force or torque around the pivot pin 140 which tends to force the eyebolt 178 vertically upward in the opening 156. This force is yieldingly resisted by the spring force of the spring washers 182 as they are slightly compressed between the collar 186 attached to the end of the eyebolt and a top surface 194 of the intermediate section 160 of the opening.

Figure 6:
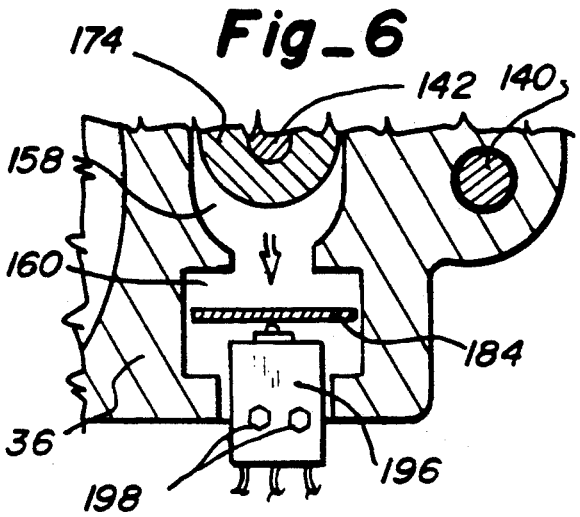
FIG. 6 is a fragmentary section taken along line 6—6 of FIG. 4.

A normally closed contact switch 196, as best seen in FIGS. 4 and 6, is attached to the cover plate 146 adjacent to the lower edge thereof by a pair of fasteners 198. The contact switch, which may be of the type manufactured by Micro-Switch, a division of Honeywell under Part Number IXE3, is located so that the extension finger 184 on the shaft 180 of the eyebolt 178 is, under normal circumstances, maintained in contact with the contact switch. The pitch adjustment of the awning 14 discussed above will not affect the location of the extension finger relative to the contact switch. Only when movement of the rafter arm 20 causes the eyebolt and collar 186, together, to move vertically upwardly in the opening 156, will the spring washers 182 be further compressed and the extension finger caused to move away from its contact with the normally closed contact switch to open the switch. Together, the eyebolt, spring washers, extension finger and contact switch are part of a switch or sensor 58 used to selectively energize the motor for retracting the awning on predetermined movement of the rafter arm associated therewith.

Figure 9:
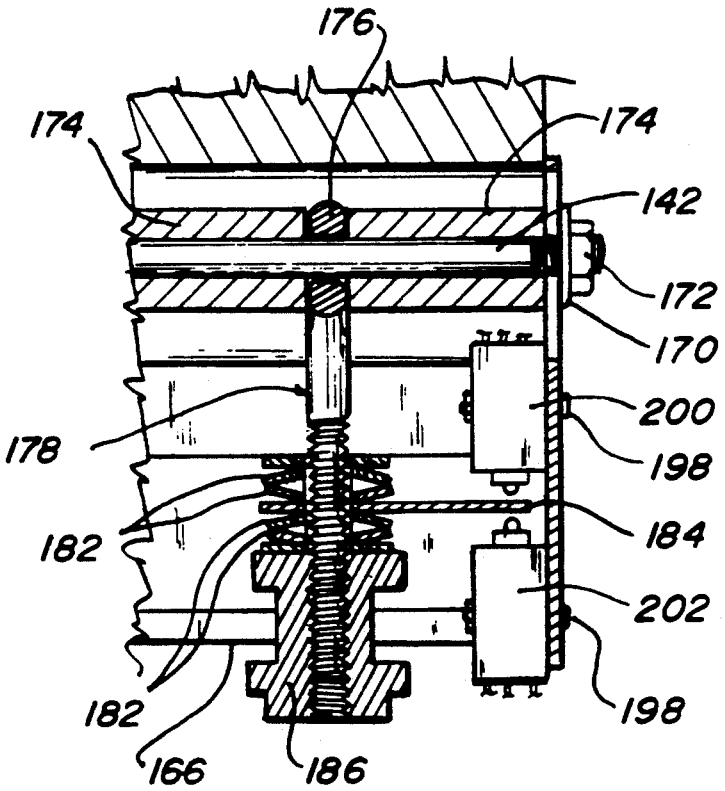
FIG. 9 is a fragmentary section similar to FIG. 4 showing an alternative embodiment of the sensor.
Figure 8:
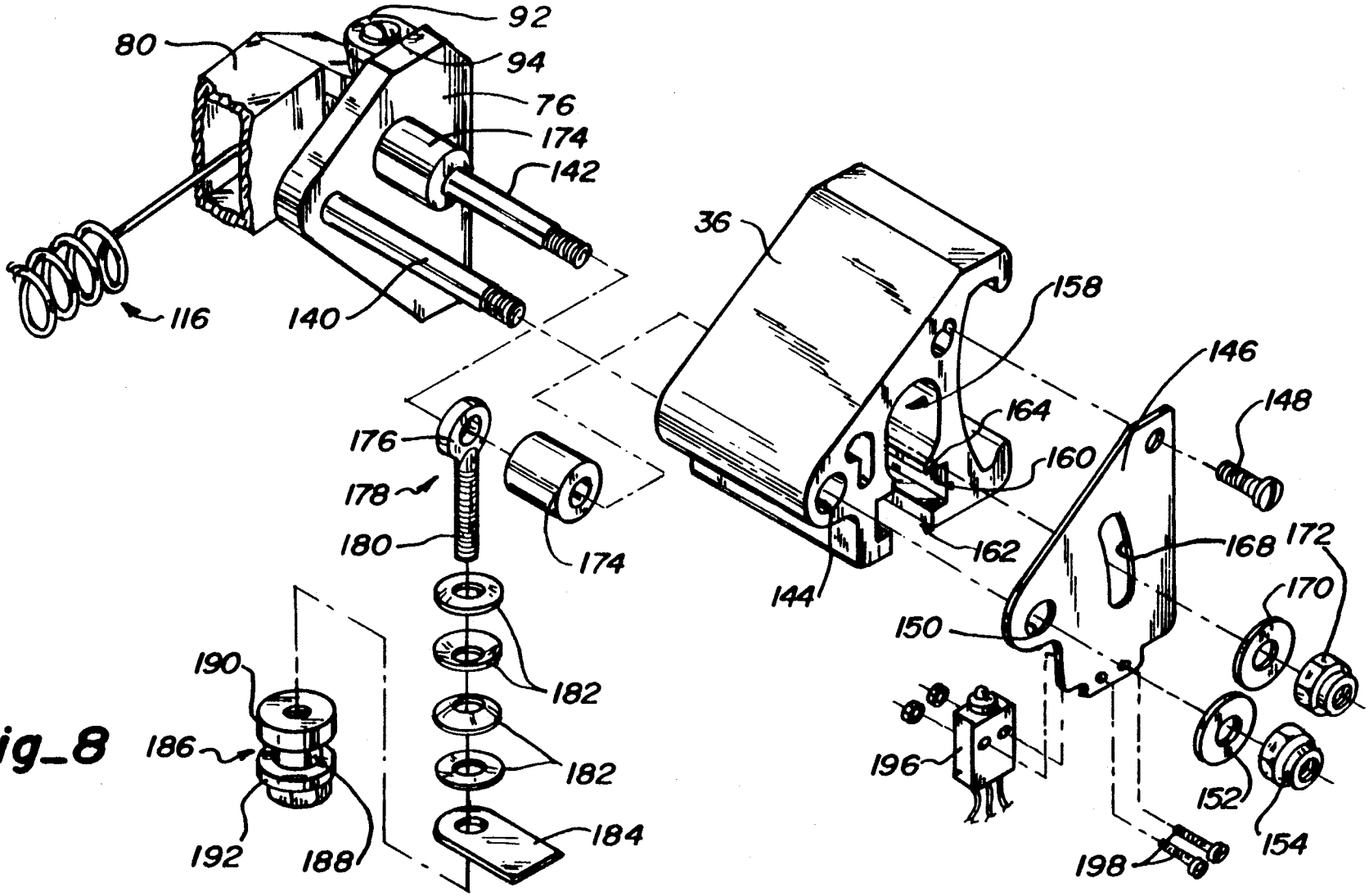
FIG. 8 is an exploded fragmentary isometric view of a portion of the rafter arm, the rafter arm support and the sensor of the awning of the present invention.

In a second embodiment of the sensor 58 shown in FIG. 9, the sensor includes an upper contact switch 200 and a lower contact switch 202. The upper and lower contact switches are mounted on the cover plate 146 in juxtaposed relationship to each other. The extension finger 184 is positioned immediately adjacent to and between the contacts of the respective normally open contact switches so that movement of the extension finger in either vertical direction will engage a contact switch to close the switch and energize the motor 40 to retract the awning 14.

In the operation of the first embodiment of the retractable awning 14 of the present invention, the internally threaded collar 186 is adjusted on the threaded portion 180 of the eyebolt 178 until the awning is at the desired pitch. The extension finger 184 of the sensor 58 will rest lightly against the contact of the contact switch 196 when the awning is in the extended position. The combined load or weight of the extended rafter arms 20, the lead bar 24, and the extended canopy 28 causes the upper rafter arm base 76, and thus the entire rafter arm 20, to pivot about the pivot pin 140 within the support bracket 36 until the force created by this load is equalized by the slightly compressed spring washers 182. The collar is in an equilibrium position with neither the upper shoulder 190 nor lower shoulder 192 resting against the support bracket. If the canopy and rafter arms are forced downwardly by the weight of collected precipitation or by the force of strong winds, the rafter arm base will pivot about the pivot pin, causing the anchor pin 142 to move vertically upwardly within the upper oval-shaped section 158 of the opening 156. This movement of the anchor pin will raise the eyebolt and collar, thereby lifting the extension finger off of the contact switch. When this occurs, the control relays 56 (FIG. 7) will command the roll bar drive motor 40 to automatically begin rolling the canopy about the roll bar 44 and thereby retract the awning. The roll bar drive motor will continue to roll the roll bar until the closed limit switch 66 is tripped by the finger 184 which in turn will tell the drive motor to stop rolling the roll bar because the awning is completely retracted.

To open or extend the awning 14, the operator may press an open switch 60 which, through the control relays 56, commands the roll bar drive motor 40 to roll the roll bar 44 in the opposite direction, thus unrolling the canopy 28 and allowing the biased extendable rafter arms 20 to extend the awning. The drive motor will continue unrolling the canopy until the opened limit switch 66 is tripped telling the control relays that the awning is completely extended and in turn commanding the drive motor to stop unrolling the roll bar. The awning can be retracted by command of the operator by actuation of the close switch 62, which, through the control relays, commands the drive motor to roll the roll bar thus rolling up the canopy and retracting the awning in a similar fashion to the automatic retraction described above. The awning is shown in the retracted position in FIG. 11.

The operation of the second embodiment of the retractable awning of the present invention differs only from the first embodiment in that the normal equilibrium position of the sensor when the awning is fully extended has the extension finger 184 adjacent to but not in contact with the normally open upper and lower contact switches 200 and 202. If the awning and rafter arms are pivoted a predetermined amount up or down, the extension finger will come into contact with the lower or upper contact switch, respectively. When either of these switches is contacted and thus closed, the roll bar drive motor 40 is commanded, through the control relays 56, to automatically retract the awning. Thus, the second embodiment has the extension finger in a no-contact position at equilibrium so that a make-contact condition with either switch will cause the awning to retract. In contrast, the first embodiment provides the extension finger in a make-contact position at equilibrium so that a no-contact position away from the switch causes the awning to automatically retract.

A presently preferred embodiment of the present invention has been described above with a degree of specificity. It should be understood, however, that this degree of specificity is directed toward the preferred embodiment. Accordingly, the invention itself is defined by the scope of the appended claims.

The invention claimed is:

1. An automatically retractable awning for mounting on a support surface, comprising in combination:

an awning sheet having a first edge operatively connected to the support surface and a second edge selectively moveable away from the support surface when the awning is extended;

a roll bar about which the awning sheet can be selectively wrapped, secured to one of said first and second edges of said awning sheet;

at least two extendable rafter arms having a first end operatively connected to said support surface and a second end operatively connected to said second edge of the awning sheet;

motor means operatively connected to the roll bar for at least selectively rolling the awning sheet about the roll bar; and sensor means operatively interconnecting at least one of the rafter arms with the motor means and adapted to sense movement of the rafter arm to energize the motor means upon a predetermined movement of the rafter arm causing the awning sheet to be rolled about the roll bar.

2. An automatically retractable awning for mounting on a support surface and movable between an extended and a retracted position, comprising in combination:

an awning sheet having a first edge operatively connected to the support surface and a second edge selectively moveable away from the support surface when the awning is extended;

a roll bar about which the awning sheet can be selectively wrapped and support means rotatably supporting the roll bar, said roll bar being positioned adjacent to the support surface and secured to said first edge of the awning sheet;

a lead bar operatively connected to said second edge of the awning sheet;

at least two extendable rafter arms having a first end operatively connected to said support surface and a second end operatively connected to said lead bar;

motor means located adjacent to said support surface and operatively connected to said roll bar for at least selectively rolling the awning sheet about the roll bar; and sensor means operatively interconnecting at least one of the rafter arms with the motor means and adapted to sense movement of the rafter arm to energize the motor means upon a predetermined movement of the rafter arm causing the awning sheet to be rolled about the roll bar.

3. An awning as defined in claim 2 wherein the operative connection of the sensor means to the rafter arm permits vertical movement of the rafter arm and the sensor means is adapted to sense the vertical movement of the rafter arm.

4. An awning as defined in claim 2, further comprising:

rafter arm support means connected to the rafter arm and operatively connected to the support surface for supporting the rafter arm.

5. An awning as defined in claim 4 wherein the rafter arm is pivotally connected to the rafter arm support means by a pivot pin.

6. An awning as defined in claim 5 wherein the sensor means senses pivotal movement about the pivot pin.

7. An awning as defined in claim 6 wherein the sensor means includes a contact switch and further comprises:

an extension finger operatively connected to the rafter arm and positioned adjacent to the contact switch to come into and out of contact with the switch as the rafter arm pivots about the pivot pin.

8. An awning as defined in claim 6 wherein the sensor means includes a first and second contact switch in juxtaposed relationship and further comprises:

an extension finger operatively connected to the rafter arm and positioned adjacent to the first and second contact switches to alternatively come into contact with the first and second switch as the rafter arm pivots predetermined distances in opposite directions about the pivot pin.

9. An awning as defined in claim 6, further comprising:

bias means operatively connected to the rafter arm and contacting the rafter arm support means to bias the pivotal position of the rafter arm.

10. An awning as defined in claim 9 wherein the bias means includes at least one spring washer.

11. An awning as defined in claim 10 wherein said bias means further comprises:

an eyebolt having an eye portion located on the anchor pin and a threaded shaft portion; and an internally-threaded collar located on the threaded shaft portion of the eyebolt to retain the spring washer thereon and adjustable along the shaft portion to adjust the pivotal position of the rafter arm.

12. An awning as defined in claim 7, further comprising:

an anchor pin operatively interconnecting the rafter arm and the extension finger.

13. An awning as defined in claim 2 wherein said support surface is substantially vertical.

14. An awning as defined in claim 2, further comprising:

rafter arm biasing means operatively connected to at least one of the rafter arms for biasing said one rafter arm toward an extended position.

15. An awning as defined in claim 14 wherein said rafter arm further comprises:

an upper rafter arm segment having a first end and a second end wherein the first end is operatively connected to said support surface;

a lower rafter arm segment having a first end and a second end wherein the second end is operatively connected to the lead bar; and a rafter arm pivot joint operatively interconnecting the second end of the upper rafter arm segment and the first end of the lower rafter arm segment so as to permit pivotal movement of the upper and lower rafter arm segments relative to each other.

16. An awning as defined in claim 15 wherein said rafter arm biasing means is located within said rafter arm and further comprises:

a cord operatively connected to the lower rafter arm segment and extending through at least a portion of the lower rafter arm segment, the rafter arm pivot joint and a portion of the upper rafter arm segment; and a spring means operatively connected to the first end of the upper rafter arm segment and to the cord for biasing the cord toward the first end of the upper rafter arm segment and thereby biasing the rafter arm toward an extended position.

17. An automatically retractable awning for mounting on a substantially vertical support surface and movable between an extended and a retracted position, comprising in combination:

an awning sheet having a first edge operatively connected to the support surface and a second edge selectively moveable away from the support surface when the awning is extended;

a roll bar about which the awning sheet can be selectively wrapped and support means rotatably supporting the roll bar, said roll bar being positioned adjacent to the support surface and secured to said first edge of the awning sheet;

a lead bar operatively connected to said second edge of the awning sheet;

motor means located adjacent to said support surface and operatively connected to said roll bar for at least selectively rolling the awning sheet about the roll bar; and at least two extendable rafter arms, further comprising:

an upper rafter arm segment having a first end and a second end wherein the first end is operatively connected to said support surface;

a lower rafter arm segment having a first end and a second end wherein the second end is operatively connected to the lead bar;

a rafter arm pivot joint operatively interconnecting the second end of the upper rafter arm segment and the first end of the lower rafter arm segment so as to permit pivotal movement of the upper and lower rafter arm segments relative to each other;

a cord operatively connected to the second end of the lower rafter arm segment and extending through at least a portion of the lower rafter arm segment, the rafter arm pivot joint and at least a portion of the upper rafter arm segment; and a spring means operatively connected to the first end of the upper rafter arm segment and to the cord for biasing the cord toward the first end of the upper rafter arm segment and thereby biasing the rafter arm toward an extended position;

a rafter arm support bracket connected to the rafter arm by a pivot pin and operatively connected to the support surface for supporting the rafter arm;

a switch operatively connected to the rafter arm support bracket to sense pivotal movement of the rafter arm about the pivot pin and communicating with the motor means to energize the motor means upon a predetermined movement of the rafter arm to cause the awning sheet to be rolled about the roll bar;

an extension finger operatively connected to the rafter arm and positioned adjacent to the switch to come into and out of contact with the switch as the rafter arm pivots about the pivot pin;

an anchor pin operatively interconnecting the rafter arm and the extension finger;

at least one spring washer;

an eyebolt having an eye portion located on the anchor pin and a threaded shaft portion;

an internally-threaded collar located on the threaded shaft portion of the eyebolt to retain the spring washer and the extension finger thereon and adjustable along the shaft portion to adjust the pivotal position of the rafter arm.

* * * * *